United States Patent [19]

Zapletal et al.

[11] 4,358,097

[45] Nov. 9, 1982

[54] SPRING ASSEMBLY

[75] Inventors: Henry Zapletal; Thomas J. Wells, both of Carthage, Mo.

[73] Assignee: Leggett & Platt, Incorporated, Carthage, Mo.

[21] Appl. No.: 212,818

[22] Filed: Dec. 4, 1980

[51] Int. Cl.[3] ..... F16F 3/02; A47C 23/04

[52] U.S. Cl. ..... 267/101; 5/271

[58] Field of Search ..... 5/247, 248, 271, 475; 267/91, 95, 97, 101

[56] References Cited

U.S. PATENT DOCUMENTS

| | | | |
|---|---|---|---|
| 2,114,918 | 4/1938 | Engstrom | 5/247 |
| 2,945,245 | 7/1960 | Gleason | 5/248 X |
| 3,489,404 | 1/1970 | Poovey | 267/101 |
| 3,685,062 | 8/1972 | Pearson | 267/91 X |

*Primary Examiner*—Duane A. Reger

*Attorney, Agent, or Firm*—Wood, Herron & Evans

[57] ABSTRACT

A spring assembly for mattresses, innersprings, and the like. The assembly comprises rows of coils, each row comprising a continuous length of wire formed into a plurality of coils interconnected by Z-shaped wire segments alternately disposed at the top and bottom of the coils. Adjacent rows of coils are connected by a helical wire wound through overlapping Z-shaped wire segments. The overlapping connected segments on opposite sides of each coil are located in a common diametrical plane of the coil so that complete compression of the coil does not result in the coil being pulled laterally, twisted and distorted.

12 Claims, 8 Drawing Figures

SPRING ASSEMBLY

The present invention relates to spring assemblies of the type commonly used in the construction of innersprings, mattresses, upholstered furniture, and the like. More particularly, the present invention relates to a mattress spring core assembly in which each of the rows of coils is formed from a single continuous length of wire.

The prior art is replete with spring assemblies useful for mattresses, innersprings, and the like. While these are of various configurations, most of them employ rows of individual coils interconnected at the top and bottom by wire lacings.

Recently, a spring assembly has been developed which is in many ways superior to an assembly which employs rows of interconnected individual coils. This new spring assembly utilizes a single continuous wire to form all of the coil springs of a row of coils. Such a construction is illustrated and described in U.S. Pat. Nos. 3,657,749 and 3,911,511.

The continuous coil spring product disclosed in U.S. Pat. No. 3,911,511 has been a commercial success, primarily because it has considerably less material for the same degree of firmness in an upholstered spring product than does a spring assembly which employs rows of interconnected individual coil springs. But the spring product disclosed in U.S. Pat. No. 3,911,511 has been found to be somewhat restrictive in its application. Specifically, it has been found that this spring product can only be employed in very firm spring products or mattresses and that it is relatively expensive to ship because it cannot be as tightly compressed for shipment as can spring products and mattresses made from individual coils.

It has therefore been an objective of this invention to provide a continuous coil spring product which is not restricted or limited to any particular firmness spring products and which may be compressed for shipment just as compactly as any comparable individual coil spring product.

The continuous coil spring product disclosed in U.S. Pat. No. 3,911,511 has been found to be somewhat limited in its application because the coils of the patented structure could not be fully compressed without becoming twisted and taking a permanent set. Therefore, the spring products disclosed in this patent were required to be shipped in packages in which the products were less than fully compressed. Additionally, the products disclosed in this patent were required to be used in "firm" mattresses only because the springs could never be subjected to full compression during normal usage.

It has therefore been another objective of this invention to provide a continuous coil spring product in which the coils could be fully compressed without becoming twisted and without the coils taking a set.

I have discovered that the reason that the coils of the spring product disclosed in U.S. Pat. No. 3,911,511 twist and take a set when fully compressed is attributable to the manner in which the coils are connected to coils in adjacent rows. Specifically, we have found that the point at which the coils of one row are connected to the coils of the two adjacent rows located on opposite sites of the one row is critical. As disclosed in U.S. Pat. No. 3,911,511 and as the commercial product disclosed in this patent has been made prior to this invention, the coils have been connected to coils of adjacent rows by a connector which is offset from a transverse diametrical plane through the coils. This offset connection results in the coils being pulled sideways and twisted as they are compressed to the extent that if they are fully compressed, the coils take an undesirable permanent set.

I have also discovered that this twisting of the coils upon compression which results in an undesirable set may be avoided by connecting each coil of each row to the coils of the two adjacent rows located on opposite sides of the coil by connectors which are located in a common diametrical plane of the coil. When so connected, the coil is not pulled sideways as it compresses and is not twisted even though it is fully compressed.

There are numerous advantages which result from connecting the coils of a continuous coil spring product in this manner. In addition to this connection enabling the products to be completely compressed and thus more tightly packed for shipment, this connection also enables the product formed by the coils to be made into numerous different products having different degrees of firmness. Prior to this invention, only a relatively few products could be made having only a very narrow range of firmness.

Still another advantage of this invention is that it enables a continuous spring product to be manufactured without the need for heat treating the completed spring product. Prior to this invention, the tendency of the coils to take a set when compressed required that the coils be heat treated and tempered after assembly so as to minimize that tendency. When made in accordance with the practice of this invention though, the continuous coil product need not be tempered after assembly.

Other advantages also accrue from the practice of this invention. Prior to this invention, when the continuous coil spring products were stacked and compressed in packages of ten or twenty products, the coils were pulled sideways and twisted to such an extent that they stuck out of the sides of the unit around the border of the spring product. These "stuck out" coils then had a tendency to grab or be grabbed by other coils, nails or objects during handling and shipment. To minimize the problem created by the coils sticking out beyond the border of the units, the spring products were customarily packaged in paper bags. With the practice of this invention, the coils compress vertically without any misalignment so that they do not stick out beyond the border of the spring unit and no longer create the snagging problem. Consequently, the products may now be shipped without having to be first inserted into paper bags.

Still another advantage of this invention is that it enables the coils of a continuous coil spring product to be made axially longer than has heretofore been possible. As an example, a three and a half turn coil may have been limited in the past to a five inch height because if made any longer, the coils would take on a set when subjected to normal usage. If used in a seven inch high mattress, this coil required that there be one inch of relatively expensive padding material on each side of the mattress. With the practice of this invention, this same three and one-half turn coil may now be made six inches in height without any chance of the coil being distorted upon compression. The result is that in this example one inch less padding may be used to make a mattress of the same height at a substantial cost savings.

These and other advantages of this invention will be more readily apparent from the following description of the drawings, in which:

FIG. 3 is a top plan view taken on line 3—3 of FIG. 2.

Figure 1:
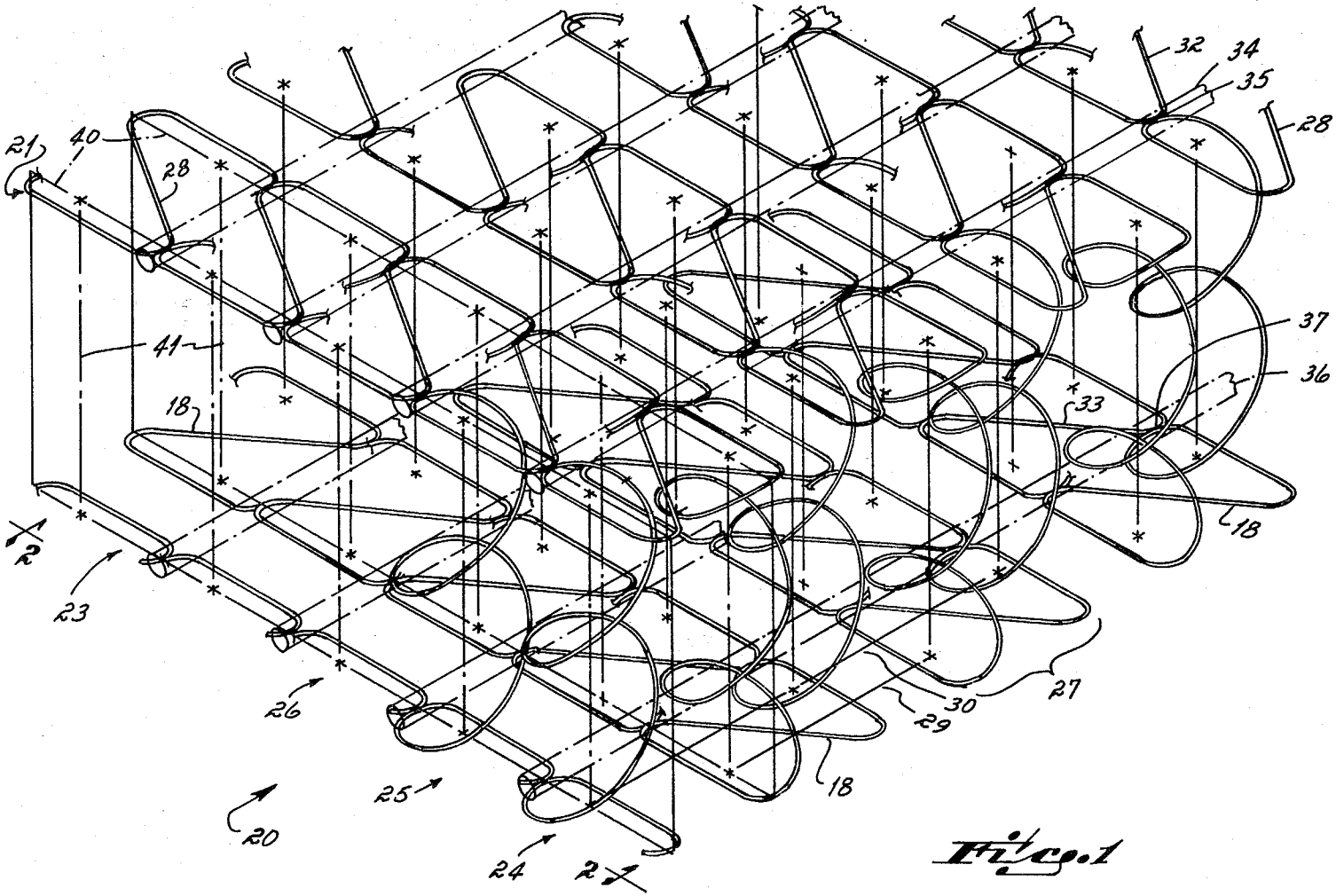
FIG. 1 is a perspective view of a corner of an innerspring embodying the invention of this application.
Figure 2:
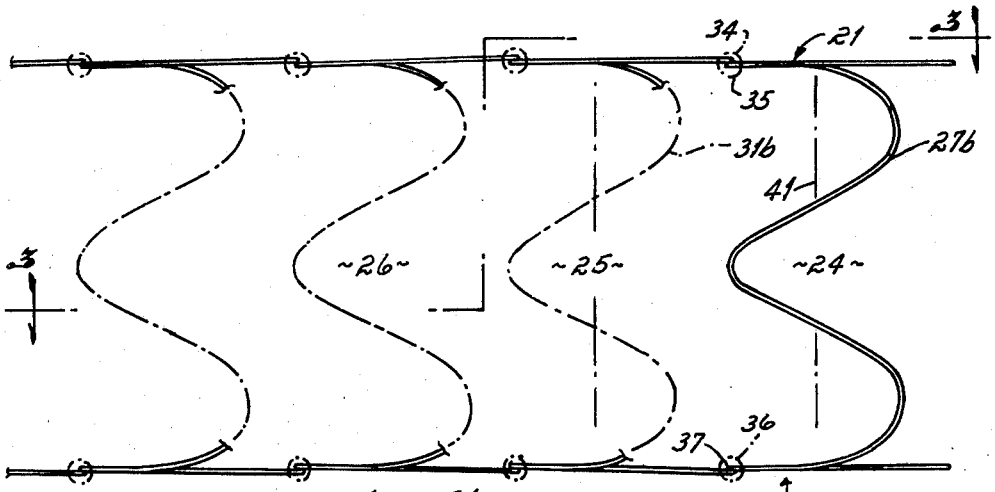
FIG. 2 is a partially diagrammatic end elevational view of the innerspring unit as viewed on line 2—2 of FIG. 1.
Figure 4:
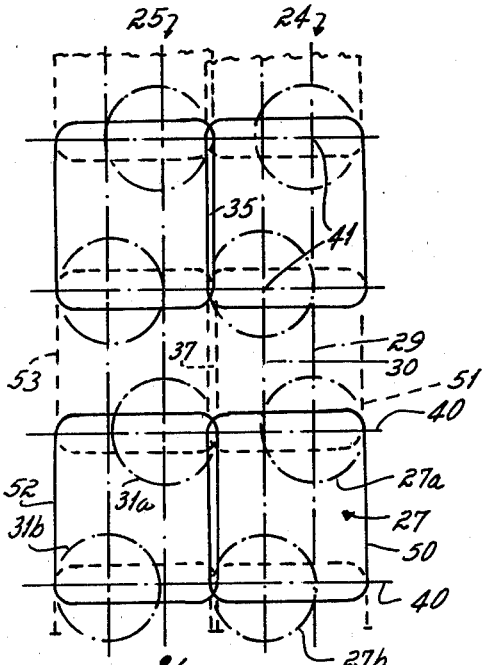
FIG. 4 is a diagrammatic plan view in which each coil pair in each row is designated by block lines constituting continuations of the Z-shaped coil interconnection segments.

Referring now to the drawings and particularly to FIGS. 1, 2 and 4, there is shown an innerspring unit 20 utilizing a spring assembly made in accordance with the invention of this application. The upper surface 21 of innerspring 20 has a generally rectangular periphery 22 which may be enclosed by a border wire (not shown). Similarly, the lower surface 23 of innerspring 20 has a rectangular periphery which also may be enclosed by a border wire (not shown).

Innerspring 20 includes a plurality of rows 24, 25, 26 of coils, all of the same twist, as, for example, all right handed twist or all left handed twist. As best illustrated in FIGS. 1 and 3, each row 24, 25, and 26 of coils is formed from a continuous length of wire. The wire is wound to form a plurality of spaced coil pairs 27 interconnected by substantially Z-shaped wire segments 28, 18 disposed sequentially first in the plane of upper innerspring surface 21 and then within the plane of lower innerspring surface 23.

As best illustrated in FIGS. 3 and 4, each coil pair 27 comprises a first right handed coil 27*a* offset from a second right handed coil 27*b*, having the same number of turns as coil 27*a*. The axes of coils 27*a* lie within a plane 29 which is parallel to, but spaced apart from, a second plane 30 within which lie the axes of offset coils 27*b*. It will be appreciated that the axes of adjacent coils 27*a* and adjacent coils 27*b* are equidistant, the axes being generally perpendicular to the upper and lower surfaces 21 and 23 of innerspring unit 20.

While each of the coils 27*a* and 27*b* is illustrated as having approximately one and one half full turns or convolutions, this number is not critical. Thus, a greater or lesser number of convolutions may be used, depending upon the tensile strength of the wire and the manner in which the coils are formed so as to provide a spring force appropriate to the particular application.

As will be appreciated from the following description, the coil interconnection technique utilized in innerspring mattress 20 prevents adjacent coils from binding when compressed even though they are not of hourglass configuration. Thus, a variety of shapes may be employed such as hourglass or potbellied, but the cylindrical shape illustrated is preferred.

Each row 24, 25, and 26 is configured identical to each adjacent row and each coil within each row 24, 25, 26 is identical to every other coil and of the same twist or hand.

In the preferred embodiment of the invention, the spacing between axes of adjacent coils within row 24 is the same as between axes spacing adjacent coils in rows 25 and 26. Further, should a coil pair in row 24 be interconnected in the plane of upper innerspring surface 21, the adjacent coil pair in row 25 is interconnected in the same plane of upper innerspring surface 21. This is best illustrated in FIGS. 1, 3 and 4 where in row 24, typical adjacent coils 27*a*, 27*b* are interconnected by Z-shaped wire segment 28 lying within upper innerspring surface 21. The adjacent coil pair 31 in row 25, coils 31*a* and 31*b*, are interconnected by a Z-shaped wire segment 32 lying in the same plane of the upper innerspring surface 21 and Z-shaped wire segment 33 lying in the same plane of the lower surface 23. This pattern is repeated throughout the innerspring unit 20. The result is Z-shaped segments in the plane of the upper surface 21 are aligned in columnar fashion and similarly the Z-shaped segments in the plane of the lower surface 23 are also aligned in columnar fashion in vertical planes which are located midway between the vertical plane of the Z-shaped segments in the plane of the upper surface 21. Otherwise expressed, the Z-shaped segments which interconnect the pairs of coils are aligned both in rows and in columns in the planes of the upper and lower surfaces 21 and 23.

In order to connect the adjacent rows of coils, the Z-shaped segments which interconnect adjacent pairs of coils within each row are positioned so that they overlap the Z-shaped segments of the adjacent row of coils. These overlapped portions or sections of the Z-shaped segments are then tied together by helical wire connectors. A first set of helical wire connectors, herein designated 34, is disposed within the plane of upper innerspring surface 21 so as to join together overlapped portions 35 of upper Z-shaped interconnection segments 28, 32. Similarly, a second set of helical wire connectors, herein designated 36, lie within the plane of lower innerspring surface 23 and serve to join together overlapped portions 37 of lower Z-shaped interconnection segments 18 and 33. As evident in the plan view of FIG. 3, the length of each helical wire is approximately the same as the length of the rows, and the helical wires 34, 36 extend parallel to the rows.

The assembly of the helical wires to the row of continuous coils may be accomplished on an assembly machine. In such a machine, the adjacent rows of coils are positioned so that the sections 35 and 37 of the adjacent Z-shaped segments are positioned in overlapping relationship and a helical wire is then rotated or screwed onto the overlapping portions of the Z-shaped segments. After completion of the threading of the helical coil onto the Z-shaped segments, the now-connected adjacent rows of coils may be indexed forwardly and another pair of upper and lower helical wires threaded over the next row of coils. This process is repeated for the desired length of the mattress, after which the spring assembly is removed from the machine.

Figure 5:
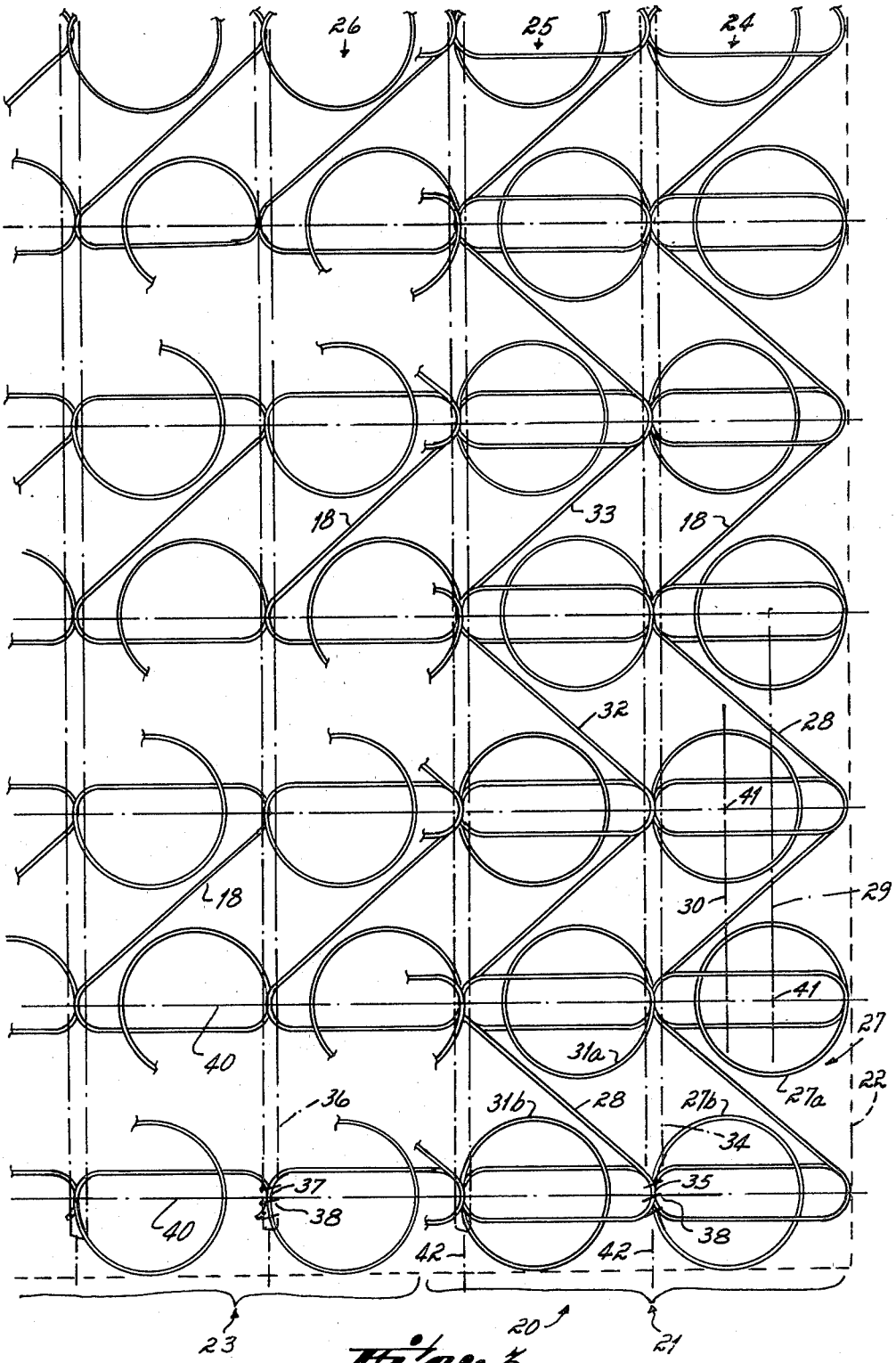
FIG. 5 is an enlarged fragmentary top plan view of a portion of the assembly shown in FIG. 3.
Figure 5:
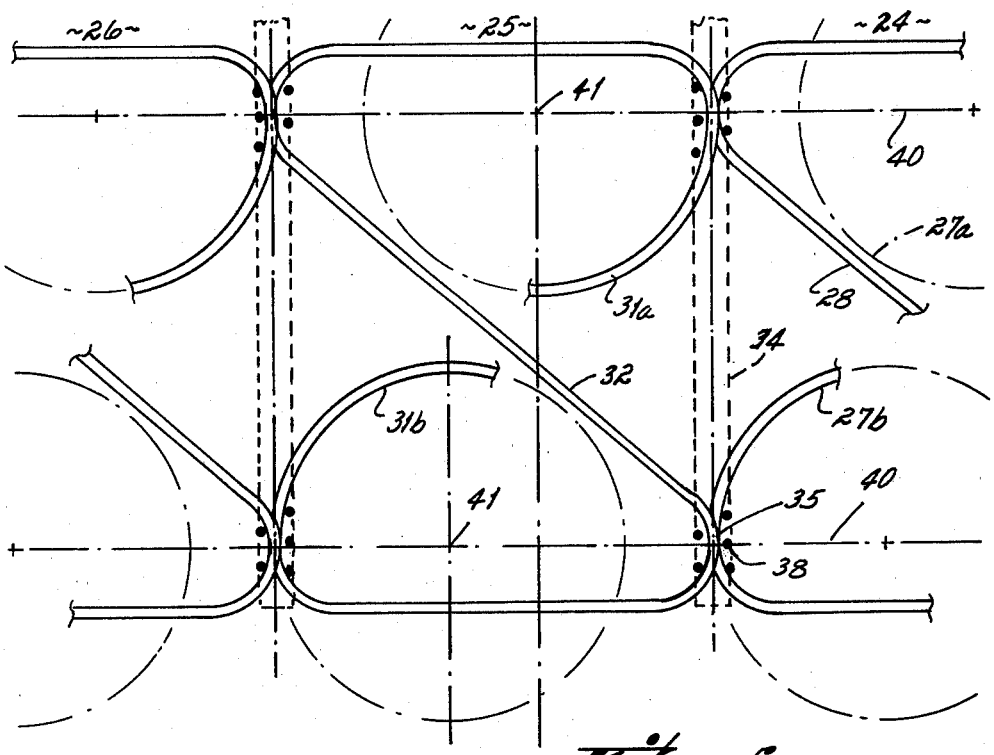

Referring now to FIG. 5, it will be seen that the diameters of the helical wires 34 and 36 are approximately one-fourth the radius of the overlapped portions 35 and 37 of the Z-shaped segments. This relationship of having the radius of the Z-shaped segments over which the helical wire is threaded approximately eight times the radius of the helical wire has the effect of permitting several rotations 38 of the helical wire to pass through and lock adjacent overlapped segments together. So locked or interconnected, the adjacent coils are free to pivot relative to each other but are locked against relative longitudinal or lateral movement. In other words, this relatively small diameter helical coil when used to lock the overlapped large radiused sections of the segments together, permits only relative pivotal movement between the adjacent interconnected coils.

Referring now to FIG. 4, each block 50 represents the outline of a typical upper Z-shaped interconnection segment 28 in coil row 24. Similarly, each block 52 represents the outline of a typical upper Z-shaped interconnection segment 32 in coil row 25. Each block 51 represents the outline of typical lower Z-shaped interconnection segment 18 in coil row 24 and each block 53 represents the outline of a typical lower Z-shaped interconnection segment 33 in coil row 25. As is apparent from the diagram in FIG. 5, the blocks 50, 52, and 51, 53 represent load supporting units. Each of these units 50, 52, and 51, 53 are overlapped so that the effect of the construction of coil assembly is one of the very densely packed innerspring assembly with a very high count of coils.

Referring now to FIGS. 1 and 5, it will be noted that the several rotations 38 of the helical wire 34 or 36 which pass around and lock adjacent overlapped segments 35 or 37 of the coils to coils of the adjacent rows are all centered in a common transverse plane 40. It will further be noted that this plane 40 passes through the vertical axes 41 of all of the coils contained in a transverse column of coils. Consequently, each coil is connected to two coils of the adjacent rows of coils by connectors 38 the centers 41 of which are located in a diametrical plane 42 of the coil. This location of the axes 41 of the coils relative to the location and shapes of the overlapped and connected segments 35 or 37 of the Z-shaped connecting segments 28, 18, 32 or 33 is important to the practice of the invention of this application. Specifically, it has been found that when the connections 38 between the coils of adjacent rows are so located relative to the axes of the coils, the coils may be fully compressed without any lateral deflection or distortion of the coils. Heretofore, such full compression of the coils has always resulted in lateral deflection and twisting of the coils with the result that the coils could never be fully compressed without taking an undesirable permanent set.

Figure 6:
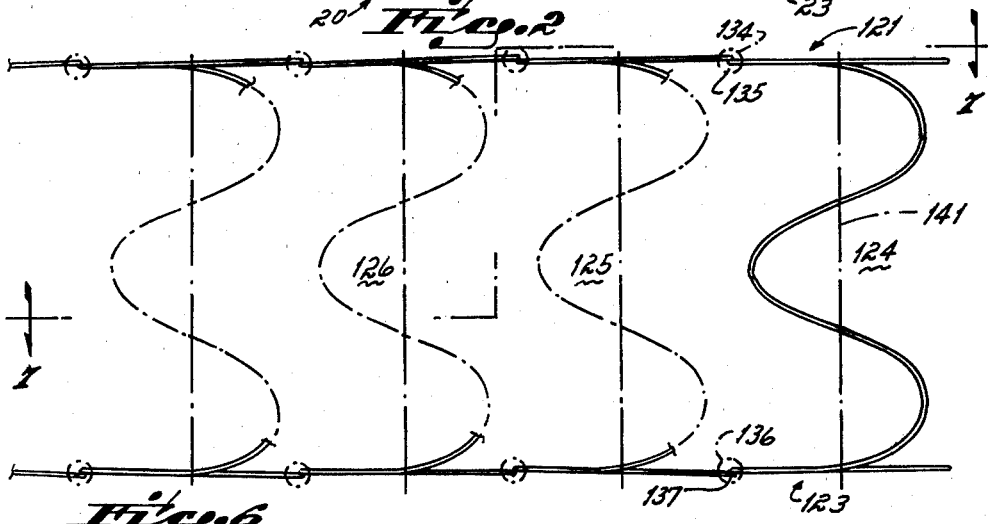
FIG. 6 is a partially diagrammatic end elevational view of a second embodiment of the invention of this application.
Figure 7:
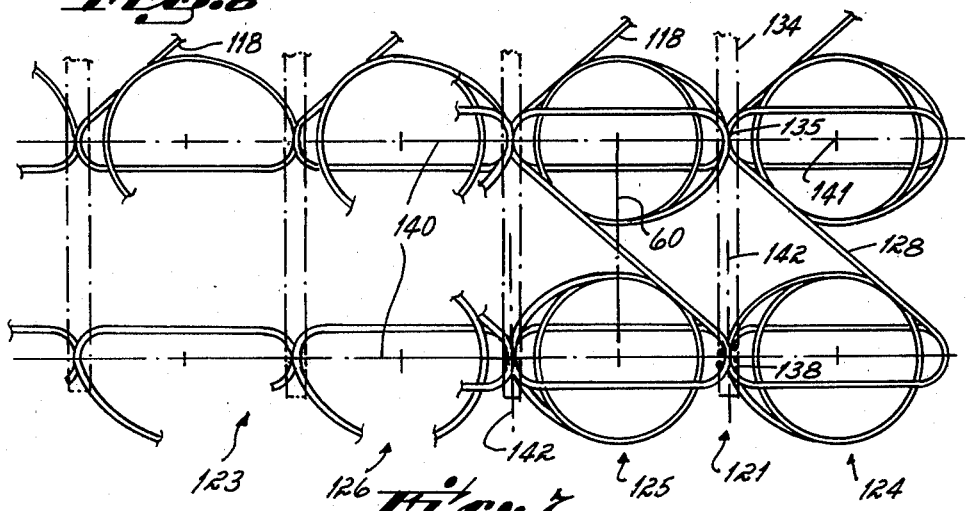
FIG. 7 is a top plan view partially broken away on line 7—7 of FIG. 6.
Figure 8:
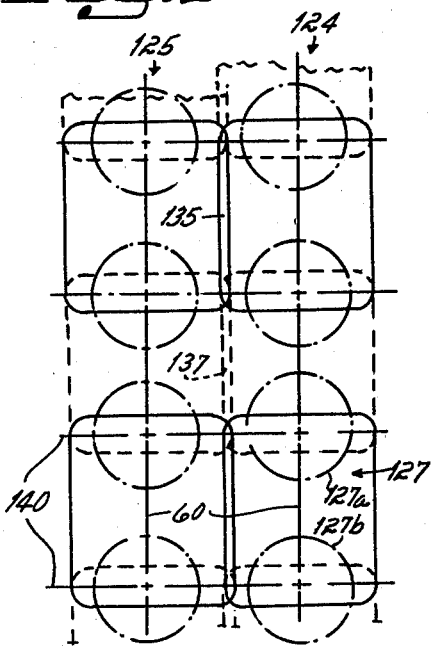
FIG. 8 is a diagrammatic plan view of the embodiment of FIG. 7 in which each coil pair in each row is designated by block lines constituting continuations of the Z-shaped coil interconnecting segments.

Referring to FIGS. 6–8, there is illustrated a second embodiment of the invention of this application. This construction is illustrated diagrammatically in top plan view in FIG. 7.

In general, the spring assembly of FIGS. 6–8 is identical to the spring assembly of FIGS. 1–5, except that the rows of coils are positioned within the interconnecting Z-shaped segments so that the vertical axes of all of the coils of a single row are located in the same vertical plane 60, rather than being alternately staggered in two different planes as in the embodiment in FIGS. 1–5. The Z-shaped segments, rather than extending outwardly from one side only of each coil extend outwardly beyond both sides of each coil so that this construction has the same advantages of the embodiment of FIGS. 1–5 in that it minimizes or eliminates any tendency of the coils to overlap or contact adjacent convolutions of the same coil. Specifically, it will be seen that in this embodiment each row of coils 124, 125, 126 is formed from a continuous length of wire and each wire is wound to form a plurality of spaced coil pairs 127 interconnected by substantially Z-shaped wire segments 128 disposed in the plane of upper innerspring surface 121. The substantially Z-shaped wire segments 118 interconnect adjacent coil pairs 127 within the plane of lower innerspring surface 123.

In this embodiment each coil pair 127 comprises a first right handed coil **127*a* offset from a second right hand coil 127*b* having the same number of turns as coil 127*a*. In this embodiment though the axes of coils 127*a* lie within the same plane 60 within which lie the axes of coils 127*b*. In this embodiment as in the embodiment of FIGS. 1–5, each row 124, 125, 126** is configured identically to each adjacent row and each coil within each row is of the same twist or hand. While the two embodiments of this invention have been illustrated as being of the same twist or hand throughout the spring unit, they could as well be of differing twist or of a mix of twists or rotational hands and still practice the invention of this application.

In this embodiment, the corners of the interconnecting Z-shaped segments are both located outwardly from the circumference of the coils **127*a* and 127*b* within each pair of coils in both the planes of the upper and lower surfaces of the mattress. This outward spacing of the Z-shaped segments facilitates interconnection of the overlapped portions of Z-shaped segments by the helical springs 134**.

Referring now to FIG. 7, it will be noted that the several rotations 138 of the helical lacing wire 134 pass around and lock adjacent overlapped segments 135 of the coils to coils of the adjacent rows. It will further be noted that as in the first embodiment of FIGS. 1–4, the Z-shaped segments are all so shaped that the locked overlapped segments are all in a common transverse plane 140. This plane 140 passes through the axes 141 of all of the coils contained in a transverse column of coils. Consequently, each coil is connected to two coils of the adjacent rows of coils by connectors 138, the centers 140 of which are located in a diametrical plane 142 of each coil. It will also be noted that in this embodiment, as in the embodiment of FIGS. 1–4, the overlapped interconnected segments 135 are radiused and that the center of radii of said overlapped sections are located in the diametral plane 140 of the coils.

The primary advantage of the continuous coil spring unit of this invention over the prior art continuous coil spring units is that is is so constructed that the coils 27 or 127 of either unit may be fully compressed without any lateral deflection or twist of the coils and without the coils taking any undesirable permanent set. As a consequence of this full compressability without distortion, the assembled spring units may be stacked and compressed for packaging much more densely than has theretofore been possible. Additionally, if so desired, the spring units of this invention may be made much less firm than has heretofore been required of continuous coil spring systems. In the past, the tendency for coils of a continuous coil spring unit to twist and take a set if excessively compressed has dictated that the unit be made so firm that it could not be fully compressed in usage. The invention of this application though enables the coils to be fully compressed without twist or distortion so that this design limitation is no longer present. As a consequence, this continuous coil spring unit may now be used in spring units or mattresses where softness, firmness or any varying degree of a firm feel is desired.

The invention of this application, because it eliminates the tendency of the coils of a continuous coil spring unit to become distorted and take a set when fully compressed, also enables these spring units to be placed in use without having to be heat treated and tempered after assembly.

While we have described only two embodiments of our invention, persons skilled in the arts to which this invention pertains will appreciate other changes and modifications which may be made without departing from the spirit of our invention. Therefore, we do not intend to be limited except by the scope of the following appended claims.

Having described our invention, we claim:

1. A spring assembly comprising:

a plurality of rows of coils, each of said rows being formed from a single continuous piece of wire and each of said rows containing a plurality of coils interconnected by Z-shaped interconnecting segments, alternate ones of said Z-shaped interconnecting segments being disposed in the planes of the upper and lower surfaces of said spring assembly, portions of said Z-shaped interconnecting segments extending beyond the periphery of said coils, the axes of said coils being disposed perpendicular to the upper and lower surfaces of said spring assembly, sections of each of said Z-shaped interconnecting segments of each row being overlapped relative to Z-shaped interconnecting segments of an adjacent row, said overlapped sections being located on opposite sides of said coils, helical spring means extending parallel to said rows for the length of said rows, said helical spring means being wound through said overlapped sections of said Z-shaped interconnecting segments so as to secure said rows of coils in an assembled relation, and said overlapped sections of said Z-shaped interconnecting segments being radiused, the center of the radii of said overlapped sections being located in diametral plane of said coils, and the center of the radii of the overlapped sections on opposite sides of each of said coils being located in the same diametral plane so that compression of said assembled coils does not cause the axes of said coils to be moved laterally or the coils to be twisted when fully compressed.

2. The spring assembly of claim 1 in which said Z-shaped interconnecting segments each generally define a rectangle of width greater than the maximum diameter of said coils, and adjacent coils within each of said rows being situated at diagonally opposite corners of said rectangles, the axes of coils in each of said rows being disposed alternately in two offset parallel planes.

3. The spring assembly of claim 1 in which the axes of all of the coils in each of said rows are disposed in a common plane.

4. A spring assembly comprising:

a plurality of rows of coils, each of said rows being formed from a single continuous piece of wire and each of said rows containing a plurality of coils interconnected by Z-shaped interconnecting segments, alternate ones of said Z-shaped interconnecting segments being disposed in the planes of the upper and lower surfaces of said spring assembly, portions of said Z-shaped interconnecting segments extending beyond the periphery of said coils, the axes of said coils being disposed perpendicular to the upper and lower surfaces of said spring assembly, sections of each of said Z-shaped interconnecting segments of each row being juxtapositioned relative to Z-shaped interconnecting segments of an adjacent row, said juxtapositioned sections being located on opposite sides of said coils, helical spring means extending parallel to said rows for the length of said rows, said helical spring means being wound through said juxtapositioned sections of said Z-shaped interconnecting segments so as to secure said rows of coils in an assembled relation, and said juxtapositioned sections of said Z-shaped interconnecting segments being radiused, the center of the radii of said juxtapositioned sections being located in a diametral plane of said coils, and the center of the radii of the juxtapositioned sections on opposite sides of each of said coils being located in the same diametral plane so that compression of said assembled coils does not cause the axes of said coils to be moved laterally or the coils to be twisted when fully compressed.

5. The spring assembly of claim 4 in which said Z-shaped interconnecting segments each generally define a rectangle of width greater than the maximum diameter of said coils, and adjacent coils within each of said rows being situated at diagonally opposite corners of said rectangles, the axes of coils in each of said rows being disposed alternately in two offset parallel planes.

6. The spring assembly of claim 4 in which the axes of all of the coils in each of said rows are disposed in a common plane.

7. A spring assembly comprising:

a plurality of rows of coils, each of said rows being formed from a single continuous piece of wire and each of said rows containing a plurality of coils interconnected by interconnecting segments, alternate ones of said interconnecting segments being disposed in the planes of the upper and lower surfaces of said spring assembly, portions of said interconnecting segments extending beyond the periphery of said coils, the axes of said coils being disposed perpendicular to the upper and lower surfaces of said spring assembly, sections of each of said interconnecting segments of each row being overlapped relative to interconnecting segments of an adjacent row, said overlapped sections being located on opposite sides of said coils, helical spring means extending parallel to said rows for the length of said rows, said helical spring means being wound through said overlapped sections of said interconnecting segments so as to secure said rows of coils in an assembled relation, and said overlapped sections of said interconnecting segments being radiused, the center of the radii of said overlapped sections being located in a diametral plane of said coils, and the center of the radii of the overlapped sections on opposite sides of each of said coils being located in the same diametral plane so that compression of said assembled coils does not cause the axes of said coils to be moved laterally or the coils to be twisted when fully compressed.

8. The spring assembly of claim 7 in which said interconnecting segments each generally define a rectangle of width greater than the maximum diameter of said coils, and adjacent coils within each of said rows being situated at diagonally opposite corners of said rectangles, the axes of coils in each of said rows being disposed alternately in two offset parallel planes.

9. The spring assembly of claim 7 in which the axes of all of the coils in each of said rows are disposed in a common plane.

10. A spring assembly comprising:

a plurality of rows of coils, each of said rows being formed from a single continuous piece of wire and each of said rows containing a plurality of coils interconnected by Z-shaped interconnecting segments, alternate ones of said Z-shaped interconnecting segments being disposed in the planes of the upper and lower surfaces of said spring assembly, portions of said Z-shaped interconnecting segments extending beyond the periphery of said coils, the axes of said coils being disposed perpendicular to the upper and lower surfaces of said spring assembly, sections of each of said Z-shaped interconnecting segments of each row being overlapped relative to Z-shaped interconnecting segments of an adjacent row, said overlapped sections being located on opposite sides of said coils, helical spring means extending parallel to said rows for the length of said rows, said helical spring means being wound through said overlapped sections of said Z-shaped interconnecting segments so as to secure said rows of coils in an assembled relation, and the center of said overlapped sections of said Z-shaped interconnecting segments being located in a diametral plane of said coils, and the center of the overlapped sections on opposite sides of each of said coils being located in the same diametral plane so that compression of said assembled coils does not cause the axes of said coils to be moved laterally or the coils to be twisted when fully compressed.

11. The spring assembly of claim 10 in which said Z-shaped interconnecting segments each generally define a rectangle of width greater than the maximum diameter of said coils, and adjacent coils within each of said rows being situated at diagonally opposite corners of said rectangles, the axes of coils in each of said rows being disposed alternately in two offset parallel planes.

12. The spring assembly of claim 10 in which the axes of all of the coils in each of said rows are disposed in a common plane.

* * * * *